United States Patent [19]

Watkins

[11] 4,416,907

[45] Nov. 22, 1983

[54] PROCESS FOR PREPARING FOOD PACKAGES FOR MICROWAVE HEATING

[75] Inventor: James D. Watkins, Golden Valley, Minn.

[73] Assignee: Golden Valley Foods Inc., Eden Prairie, Minn.

[21] Appl. No.: 430,045

[22] Filed: Sep. 30, 1982

Related U.S. Application Data

[60] Division of Ser. No. 283,145, Jul. 13, 1981, which is a continuation of Ser. No. 33,972, Apr. 27, 1979, abandoned.

[51] Int. Cl.[3] ..... B65B 29/08; A23L 1/01

[52] U.S. Cl. ..... 426/234; 426/393; 426/407; 219/10.55 E; 219/10.55 M

[58] Field of Search ..... 426/107, 113, 234, 241, 426/242, 243, 393, 524, 407; 219/10.55 E, 10.55 M; 99/451, 447, 428

[56] References Cited

U.S. PATENT DOCUMENTS

| | | | |
|---|---|---|---|
| 1,099,603 | 6/1914 | Ingersoll | 426/113 |
| 1,476,910 | 12/1923 | Naugle . | |
| 1,906,592 | 5/1933 | Hiester . | |
| 2,039,374 | 5/1936 | Young | 426/113 |
| 2,271,921 | 2/1942 | Luker | 426/128 |
| 2,290,396 | 7/1942 | Webster . | |
| 2,540,036 | 1/1951 | Spencer | 426/243 |
| 2,559,101 | 7/1951 | Wool . | |
| 2,576,862 | 11/1951 | Smith et al. | 426/234 |
| 2,600,566 | 6/1952 | Moffett | 426/234 |
| 2,660,529 | 11/1953 | Bloom . | |
| 2,714,070 | 7/1955 | Welch | 426/234 |
| 2,960,218 | 11/1960 | Cheeley | 426/113 |
| 2,961,520 | 11/1960 | Long | 219/10.55 E |
| 3,141,400 | 7/1964 | Powers | 426/113 |
| 3,179,036 | 4/1965 | Luker | 99/428 |
| 3,191,520 | 6/1965 | Halter | 99/442 |
| 3,219,460 | 11/1965 | Brown | 426/107 |
| 3,220,856 | 11/1965 | Vischer | 426/113 |
| 3,240,610 | 3/1966 | Cease | 426/113 |
| 3,246,446 | 4/1966 | Powers | 426/128 |
| 3,262,668 | 7/1966 | Luker | 99/428 |
| 3,271,169 | 9/1966 | Baker et al. | 426/107 |
| 3,547,661 | 12/1970 | Stevenson | 426/107 |
| 3,610,135 | 10/1971 | Sheridan | 99/430 |
| 3,865,301 | 2/1975 | Pothier et al. | 426/107 |
| 3,881,027 | 4/1975 | Levinson | 219/10.55 E |
| 3,884,213 | 5/1975 | Smith | 99/473 |
| 3,884,383 | 5/1975 | Burch et al. | 150/0.5 |
| 3,941,967 | 3/1976 | Sumi et al. | 219/10.55 E |
| 3,965,323 | 6/1976 | Forker et al. | 219/10.55 E |
| 3,974,353 | 8/1976 | Goltsos | 219/10.55 E |
| 3,975,552 | 8/1976 | Stanbroom | 426/243 |
| 3,985,990 | 10/1976 | Levinson | 219/10.55 E |
| 4,031,261 | 6/1977 | Durst | 426/144 |
| 4,133,896 | 1/1979 | Standing et al. | 426/107 |

OTHER PUBLICATIONS

Nupac Publication, Tacoma, Wash. "Fluted Tube Pan".

*Primary Examiner*—Steven L. Weinstein

*Attorney, Agent, or Firm*—James V. Harmon

[57] ABSTRACT

The invention concerns a disposable microwave food shipping and heating container and a method of preparing food for microwave heating. The container includes a generally bowl-shaped or dish-shaped bottom portion to hold the food product. It has a bottom wall that is transparent to microwave energy and an upwardly extending side wall. The upper edge of the side wall defines an opening for filling the container with food and for removing food when it is to be served. A cover formed from sheet material extends across the opening of the container to seal the opening. Within the container is a low loss core formed from microwave transparent packaging material. The core extends vertically between the top and the bottom of the container to provide a tubular microwave influx passage through the food within the container.

To prepare the package, a food product is placed in the disposable shipping container but the interior of the core is maintained free from food. The container and food product are then chilled. Chilling usually solidifies the food to a predetermined shape. A tubular passage extends through the food around each core. The food product is then distributed in the package and subjected to microwave heating within the package whereby microwave energy will readily pass into the package through the core to facilitate heating of the food especially that portion surrounding the core throughout the heating cycle.

7 Claims, 17 Drawing Figures

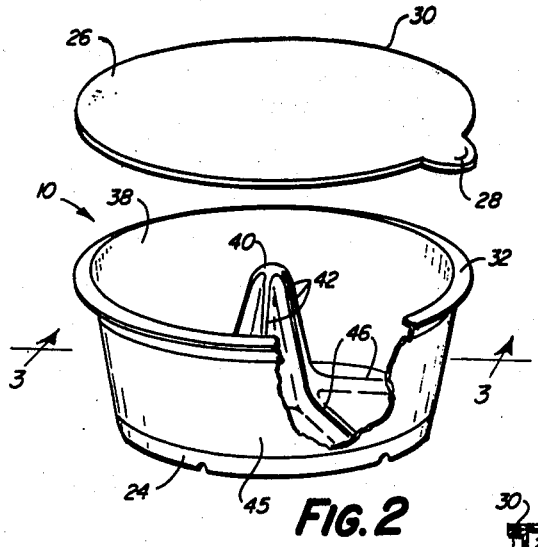

FIG. 2

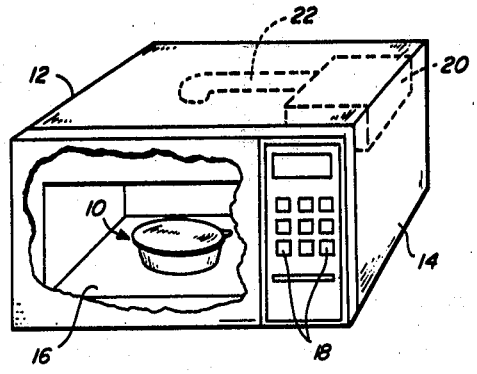

FIG. 1

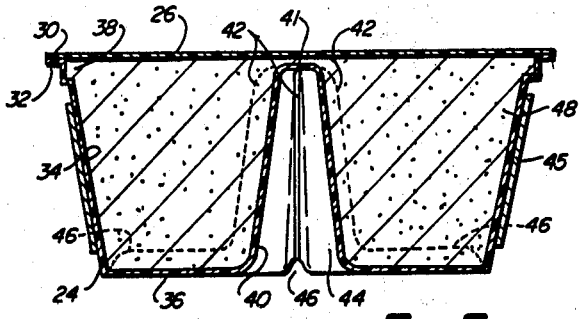

FIG. 3

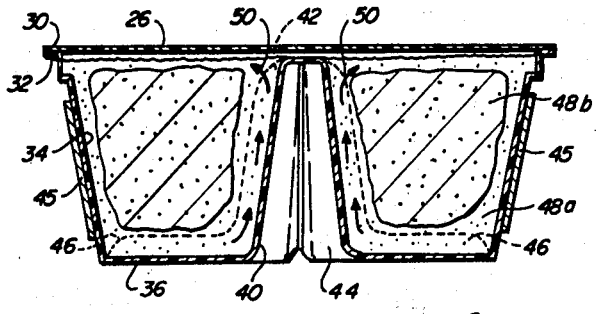

FIG. 4

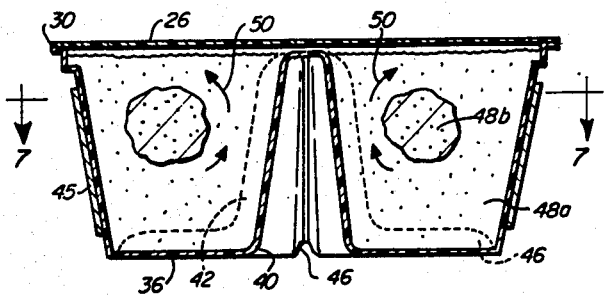

FIG. 5

PROVIDE A DISPOSABLE SHIPPING CONTAINER INCLUDING A LOW LOSS FOOD MOLDING CORE THAT IS TRANSPARENT TO MICROWAVE ENERGY

FILL THE CONTAINER WITH A FOOD PRODUCT AND MAINTAIN THE INTERIOR OF THE CORE FREE FROM THE FOOD

EACH CORE MOULDING A TUBULAR MICROWAVE INFLUX PASSAGE WITHIN THE FOOD

CHILLING THE CONTAINER AND THE FOOD THEREIN TO SOLIDIFY THE FOOD TO PREDETERMINED SHAPE WITH THE TUBULAR PASSAGE THROUGH THE FOOD AROUND EACH CORE

DISTRIBUTING THE FOOD WITHIN THE CONTAINER WHEREBY DURING SUBSEQUENT MICROWAVE HEATING, MICROWAVE ENERGY WILL READILY PASS THROUGH THE CORE AND HEAT THE FOOD AROUND THE CORE

FIG. 16

PROCESS FOR PREPARING FOOD PACKAGES FOR MICROWAVE HEATING

This is a division of an application bearing the same title filed July 13, 1981, Ser. No. 283,145 which is a continuation of Ser. No. 33,972 filed Apr. 27, 1979, now abandoned.

FIELD OF THE INVENTION

This invention relates to the packaging of food products that are to be heated in a microwave oven.

THE PRIOR ART

The vast increase in demand for microwave heating ovens particularly those used by the consumer has resulted in a need for packaged food products that can be heated in these ovens quickly, efficiently, and uniformly. The results have, however, often been disappointing. Two of the most common problems are the unevenness of heating and the presence of dry spots in some areas where the food has been overheated together with cool or icy spots in other parts of the package. This unevenness in temperature is largely the result of what is sometimes referred to as run-away heating, a term used to designate heating in localized areas that often continues until it reduces or destroys the palatability of the food product. The problem is particularly troublesome with frozen food products because ice crystals themselves are relatively transparent to microwave energy. Hence, they do not absorb the energy at the rate liquid water absorbs energy.

Thus, the liquid portion of food product held in an ordinary dish or bowl will heat at a very rapid rate but frozen portions take up heat slowly and tend to remain frozen. When a package is subject to runaway heating, temperatures rise faster in the outer portions of the package. For example, in tests that have been run in the development of the present invention it was found that one frozen food reached 180° F. on the outside surface but was at about 0° F. near center. Performance of this kind is entirely unacceptable.

It has been suggested in receipe books to pile up food, for example potatoes, in a circle around the edge of the plate to provide more uniform heating. This helps but requires manual attention and is not suited for fluid or liquid foods.

Many attempts have been made to improve microwave heating. For example, U.S. Pat. No. 3,985,990 describes a baking utensil having a microwave transparent top and compartmented metallic container with a central divider separating two different food substances shown in FIG. 2 of patent. The entire container is held in a paper pie plate. No provision is made, however, for improving the uniformity of heating within each of the two food bodies.

U.S. Pat. Nos. 2,600,566 and 2,714,070 in FIGS. 2 and 7, respectively, describe packages for two different food substances such as ice cream on the outside and ice cream topping on the inside. The topping in each case is contained in an edible dish within the ice cream. The ice cream itself is held within a metal shield. During heating, the ice cream remains frozen while the topping is heated at a much faster rate. An important result accomplished by each patent is to keep a food product from being heated above the freezing point. By contrast, the present invention will increase heat absorbtion.

U.S. Pat. No. 3,965,323 describes a method and apparatus for heating and browning foods in a microwave oven through the use of a shallow ceramic dish having a peripheral U-shaped channel. A surface coating is applied to the bottom of the central portion of the dish. This coating becomes extremely hot; hot enough to brown or sear the bottom of the food product. Because of its heavy weight, the dish is not suitable for shipping and serving foods. Its primary utility is in browning the surface of a food product such as steak.

U.S. Pat. No. 3,271,169 discloses a food package for microwave heating comprising a plastic tray having several food containing compartments separated by partitions. The bottom wall of different portions of the tray may have different heights causing the food to heat at different rates. Some of the compartments are provided with a recess around the periphery. The tray has utility in heating a meal containing several foods.

The patent to Durst U.S. Pat. No. 4,031,261 provides a beverage composition that can be thawed from frozen condition with microwave energy. The beverage is frozen as many separate chunks or with a central hole. One major problem with this approach is that during heating, the melted beverage quickly fills up the spaces or openings. In this way the entry of microwave energy through any opening or passage that was initially present is interrupted. Accordingly, the advantage of an opening is lost after the initial heating period melts a portion of the food.

It is also known to provide compartmented or non-compartmented containers with partial microwave shielding e.g. aluminum foil as described for example in U.S. Pat. Nos. 3,219,460 and 3,547,661. These patents show the principle of selective microwave admission through a slotted shield. However, there is nothing present to facilitate entry of the microwave energy into the food itself.

The general objective of the invention is to overcome these and other deficiencies of the prior art. These and other more detailed and specific objects of the invention will be apparent from the accompanying description and drawings.

THE FIGURES

FIG. 1 is a perspective view of a microwave heating container as seen during heating within a microwave oven.

FIG. 2 is a perspective view of a heating container on a larger scale partially broken away for clarity of illustration with the top elevated so that the interior can be seen.

FIG. 3 is a vertical sectional view taken on line 3—3 of FIG. 2 with the food entirely frozen.

FIG. 4 is a view similar to FIG. 3 after heating had been started.

FIG. 5 is a view similar to FIGS. 3 and 4 during a later stage of heating.

Figure 8:
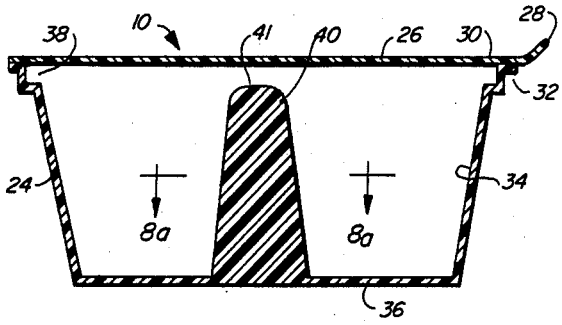
FIG. 8 is a vertical, sectional view of another form of container in accordance with the invention.

FIG. **8*a* is a horizontal sectional view taken on line 8*a*—8*a* of FIG. 8**.

Figure 9:
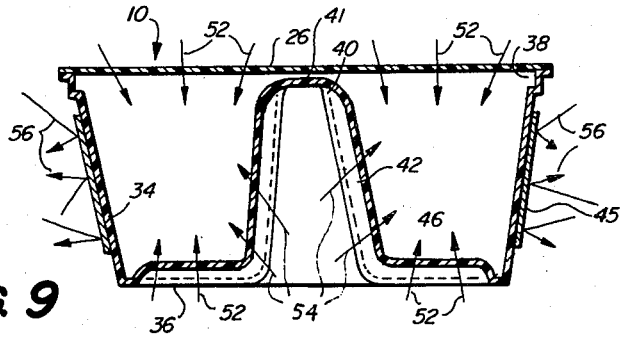

FIG. 9 is a vertical cross-sectional view of the container of FIGS. 1 through 5 showing microwave energy entering and reflected from portions of the container.

Figure 10:
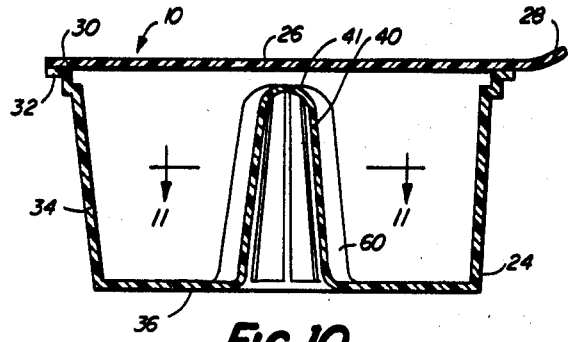

FIG. 10 is a vertical cross-sectional view of another embodiment of the invention.

Figure 11:
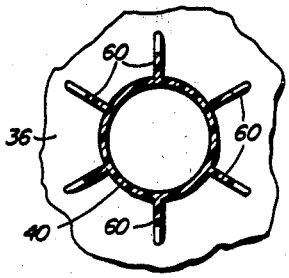

FIG. 11 is a horizontal partial cross-sectional view taken on line 11—11 of FIG. 10.

Figure 12:
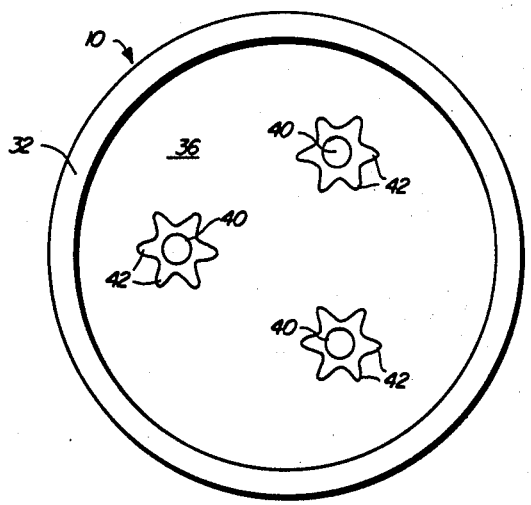

FIG. 12 is a top view of food heating container in accordance with another form of the invention with the top removed.

Figure 13:
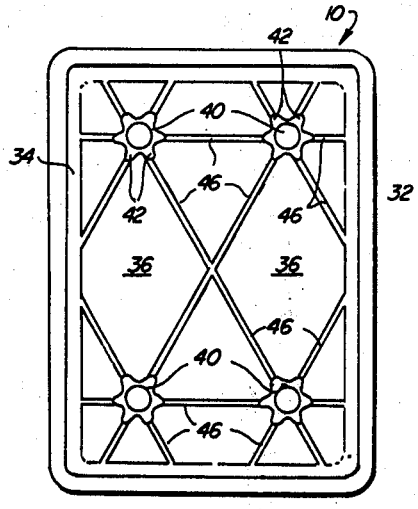

FIG. 13 is a top view of another form of package in accordance with the invention.

Figure 14:
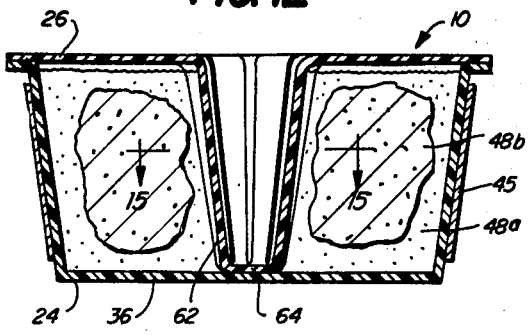

FIG. 14 is a vertical cross section of still another modified form of the invention.

Figure 15:
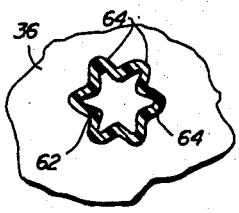

FIG. 15 is a horizontal partial transverse sectional view taken on line 15—15 of FIG. 14 and FIG. 16 is a schematic flow diagram of the process.

SUMMARY OF THE INVENTION

The invention concerns a disposable microwave food heating container and a method of preparing food for microwave heating. When filled with food the container may be referred to as a package. The container includes a generally bowl-shaped or dish-shape bottom portion to hold the food product. The container includes a bottom wall that is preferably transparent to microwave energy and an upwardly extending sidewall defining an opening at its top for filling the container with food and for removing food when the food is to be served. A cover formed from sheet material preferably extends across the top opening of the container and seals the opening. Within the container is a low loss core formed from microwave transparent packaging material. The core extends vertically between the top and the bottom of the container to provide the tubular microwave influx passage through the food in the container.

In the method of preparing food in accordance with the invention, a food product is placed within the disposable shipping container. A tubular passage extends through the food surrounding the core. The interior of the core is maintained free from food. The container and food product are then chilled. In most but not all foods chilling stiffens or solidifies the food to predetermined shape such that a tubular passage having the shape of the core extends through the food around each core. The resulting packaged food may be shipped or distributed in commerce. It is then subjected to microwave heating within the package whereby microwave energy will readily pass into the package through the core to accelerate heating of the food and especially that portion near the core throughout the application of microwave energy. The invention, it was discovered, also makes the temperature much more uniform throughout.

Briefly, the process employed in the present invention comprises first providing a food product with dipolar molecules i.e., molecules that will couple with microwave energy. Coupling of the food product with microwave energy heats the food product; and such is the meaning to be attached to the term "coupling". The disposable shipping container already described is then filled with the food product. As the container is filled in a preferred embodiment of the invention each core molds or shapes the food such that a tubular microwave influx passage is present in the food at the location of each core. Chilling is carried out to any desired temperature. If the product is to be distributed at refrigerated temperature, chilling is usually carried out to a temperature of about 40° F. If the food is to be frozen, the temperature is reduced to about 0° F. The filled containers or packages are then distributed with the food still in the package. It is then placed in the microwave oven and heated so that microwave energy enters the food product through the container including the food molding core which defines a microwave influx passage in the food. This heats the portion of the food surrounding the core but does not heat the core itself except for heat transmitted to the core by conduction from the food. The presence of the core in the food will maintain the microwave influx passage intact during the heating period and during the liquefaction of the food surrounding the core.

During the development of the invention it was discovered that while being heated the liquefied portions of the food will actually flow upwardly in the vicinity of the core and this flow of liquefied food helps to distribute heat throughout the package. The core thus can also be thought of as a guide for directing the flow of the heated food. The core is preferably positioned vertically in the package and can project downwardly from the top of package or upwardly from the bottom of the package. In a preferred form of the invention, the core extends into proximity with the wall of the package opposite that from which it is supported, that is to say, to less than about an inch and preferably only a small fraction of an inch from the opposite wall. In one form of the invention the core actually touches the opposite wall of the container.

In a preferred form of the invention, the core is provided with flow guiding ribs that extend longitudinally thereof to guide the flow of liquid longitudinally of the core. The ribs can comprise longitudinal corrugations or other irregularities that extend longitudinally. These ribs can, if desired, be extended radially outward from the bottom of the core along the bottom wall of the container and if such extensions are present they guide the flow of liquefied food centrally toward the bottom of the core.

A cover or closure can conveniently be formed from sheet material and is secured across the top opening of the container in a preferred form of the invention. The cover can comprise either microwave transparent or microwave reflective sheet material such as metal foil.

In another form of the invention a ring of microwave reflective material is provided around the periphery of the container. The ring can comprise a strip of metal such as aluminum foil bonded to the outside surface of the container. Such a strip will prevent penetration of microwave energy through the side of the container and promote its entry from the top and bottom. This selective shielding in a preferred embodiment is characterized in that the amount of energy entering the food is not reduced. That is, the temperature change of the total mass of food is equal to or greater than that of a non-shielded package. The shield merely reduces the temperature differential within the container. This is particularly important in that the shielding provided by the invention, instead of interfering with or slowing down heating, improves the efficiency and speed of microwave heating; the very reason that microwave ovens are used.

DETAILED DESCRIPTION

The invention will now be described by way of example in connection with FIGS. 1 through 7.

As seen best in FIG. 1, a disposable food package 10 embodying the invention is placed during heating in a microwave oven 12 of any suitable known construction. The microwave oven 12 includes the usual oven housing 14, heating compartment 16 which is closed by a door that is partially broken away in the drawing to show the interior of the heating compartment. Controls 18 regulate the operation of a microwave generator or magnetron 20 that provides microwave energy through a wave guide 22 to the interior of the microwave heating compartment 16. As shown in the figures, a disposable food package 10 is placed in the heating compartment 16.

Refer now to FIGS. 2 through 5. As seen in these figures, the package 10 includes a generally dish-shaped container body 24 formed from microwave transparent material such as molded plastic which after it is filled is sealed by a cover 26 formed from flat stock such as suitable packaging sheet material. The cover is provided with a lifting tab 28 so that it can be easily removed.

As seen best in FIGS. 2 through 5, the container body 24 includes a generally upwardly extending circular sidewall 34 and generally flat bottom wall 36. The container body has a top opening 38 through which the food can be introduced and removed. The cover is sealed by adhesive at its periphery 30 to a circular lip or flange 32 at the upper edge of the sidewall 34. If desired, the cover can in the alternative be snap fitted over the sidewall.

The container body includes a central core 40 which in this instance is disposed vertically. The core 40 is integral with and extends upwardly from the bottom wall 36. It comprises a hollow thin-walled upwardly directed finger-like projection contoured from the bottom wall 36 that extends into proximity with the top wall 26, that is to say, close to the plane of the lip 32 at the top edge of the sidewall 34. As seen in the figures, the core 40 tapers slightly toward the center proceeding upwardly toward its top end. It is closed at its upper end 41. The core 40 is thus integral with the bottom wall 36 and is composed in this instance of the same material from which the bottom wall is formed. Distributed circumferentially of the core 40 are a plurality of longitudinally and vertically extending generally parallel ribs 42 which in this instance comprise corrugations in the wall of the core.

The ribs 42 also extend peripherally and radially across the bottom wall of the container to define radial rib extensions 46. It can be seen in FIGS. 2 and 3 that rib extensions 46 project upwardly from the bottom wall 36. It is, however, possible to form extensions 46 so that they project downwardly below the surface of the bottom wall 36 instead of extending upwardly as shown. Extending around the sidewall 34 is a microwave reflective ring such as an aluminum foil strip 45.

While six ribs are shown, a larger number of ribs can be used. For example, ten or more ribs may be used in some cases. Thus the precise number of ribs is not considered critical. From about four to ten ribs appear to be optimum on the basis of current tests. Within the food package is provided food product 48 containing dipolar molecules such as water or fat. While a variety of foods can be provided, typical foods include meal entrees, such as chili, baked beans, spanish rice, macaroni and cheese, soups, etc.; vegetable dishes such as creamed asparagus, spinach, corn, peas, carrots, etc., and any of a variety of fruit dishes, beverages or desserts such as custards, puddings, etc.

The food product of FIG. 3 is frozen and is shown as it appears when the package 10 is just withdrawn from the freezer. After a short period of heating as shown in FIG. 4, the periphery of the food product becomes thawed as shown at 48*a*. The frozen portion 48*b* remains as a ring located generally between the core 40 and the sidewall. It will be noticed the food product is liquefied in the area immediately surrounding the core. This illustrates the effectiveness of the core in helping to heat the center portion of the food within the container. It was observed during operation that while the food product is being heated, a portion of the food product surrounding the core flows upwardly in the area immediately adjacent to the core. This flow has been indicated generally at 50 in FIGS. 4 and 5.

If desired, the cover 26 can be made of microwave energy reflective material such as aluminum foil or foil coated paper in which case it is preferred not to use the shielding ring 45. When the cover 26 is formed from aluminum foil, all of the microwave energy must enter the package from the sides and bottom.

Refer now to FIG. 9 which illustrates the microwave energy depicted by arrows 52 entering the package at the top and bottom. The figure also shows microwave energy entering the package along lines 54 which extend from the core into the food. Microwave energy striking the side of the package (lines 56) will be reflected and enter at 52 or 54 where it will be absorbed. It can be seen in this way that the core 40 forms a microwave influx passage through the food product and that this passage remains intact the entire time the food product is heated.

Figure 8A:
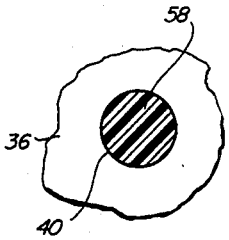

Refer now to FIGS. 8 and 8*a* which show a modified form of container in accordance with the invention with corresponding parts illustrated by the same numerals used in FIGS. 1 through 7 and 9.

The container 10 in FIGS. 8 and 8*a* is the same as that already described except for the core 40 which in this case comprises a non-loss or low loss microwave transparent body which is homogeneous throughout. The core in this instance can be solid plastic, foamed plastic, molded paper, etc., or a combination of them. One preferred core material comprises foamed polystyrene. The interior 58 of the core is not hollow in this instance as it was in the previous figures. Its function is however the same. Since the core 40 is transparent to microwave energy, the core forms an influx passage through the center of the food product allowing microwave energy to enter through the core and pass readily into the food surrounding the core. During heating, the core remains intact as before thereby holding the microwave influx passage in place within the liquefied food product. This allows microwave energy to enter through the core during the entire heating period.

The embodiment of FIGS. 8 and 8*a* is particularly advantageous when it is desired to use an ordinary flat bottomed dish without a central core. In such a case, the core 40 of FIGS. 8 and 8*a* is a separate piece of material which can be bonded to the center of a flat bottom wall 36 during fabrication. It will be noted that the core 40 in this instance has a smooth exterior surface and is without ribs. However, as described above in connection with the prior figures, the addition of ribs will provide greatly improved performance for most foods. Satisfactory performance can be obtained for some foods without using ribs.

Refer now to FIGS. 10 and 11 wherein the same numerals refer to corresponding parts already described. The disposable food package 10 is in all respects similar to that described in FIGS. 1–7 and FIG. 9 except for the core 40 which in this instance is provided with a different type of rib. The ribs in this case comprise a plurality of longitudinally extending, circumferentially spaced flanges 60. It will be seen that the flanges are integral with the core 40 and project radially outward therefrom. The flanges 60 function generally similar to the ribs already described to provide channels therebetween which function to guide the flow of liquefied food upwardly along the outer surface of core 40. This helps to distribute the heat during the heating operation thereby increasing the uniformity of temperature within the heated food product.

Refer now to FIG. 12 which illustrates a modified form of package. The disposable food package 10 in this case is provided with a bottom wall 36 having three upwardly projecting cores 40 each of which is provided with six longitudinally extending circumferentially spaced ribs 42. This embodiment is preferred for containers of larger sizes in which additional interior heating is desired. Thus during operation the microwave energy will enter the food through the microwave transparent cores 40 at three different locations for the food contained in the package.

Refer now to FIG. 13 which illustrates a further modified form of the invention. The package is similar to those already described with the following changes. The outline of the sidewall package is rectangular rather than circular and the flange 32 at the top of the sidewall 34 is also rectangular. In addition, the container 10 is provided with four spaced-apart, vertically-extending cores 40 each with a plurality of longitudinally extending ribs 42 which are coextensive at their lower ends with radial rib extensions 46 which radiate outwardly from the base of each core 40. Some of the rib extensions are connected together at their ends. As seen from above, the connected ribs 46 form a latticework between the cores 40. Each converging set of radial rib extensions surrounding each core 40 helps to guide the liquefied food toward the base of each core.

Referring now to FIGS. 14 and 15 which show another modified form of the invention, the disposable food package 10 is generally similar to that described above except for the core 62. The core 62 in this case is integral with and supported by the cover 26. Thus, the core comprises a hollow, finger-like projection extending downwardly from the plane of the cover 26 into proximity with the bottom wall 36. Since the core 62 is part of the cover, the container 24 has a flat bottom 36 which is uninterrupted. As a result, food can be spooned from the container more easily than in the above-described embodiments. It will be seen that the free, unsupported end 64 of the core 62 extends into proximity with the bottom wall 36. In this instance it actually contacts the bottom wall 36. The core 62 is provided as can be seen with the plurality of radially projecting, longitudinally extending ribs or corrugations 64 within the wall of the core 62. These ribs serve as before to help direct the flow of melted liquefied food product longitudinally of the core thus distributing the heat around the surface of the frozen portion 48*a*.

The process used for preparing foods in accordance with the invention will now be described in connection with FIG. 16.

A disposable shipping container of a suitable size is provided. If a single serving container is to be used, it may contain about 5–10 ounces of food. In this instance the container would have a height of about 1.75 inches and a diameter of about 3.9 inches at the top. The heating core is transparent to microwave energy as already described. The container is filled with the food product. It should be noted that the interior of the core is maintained free from food. Usually the container is filled almost to the top with a portion of the core projecting out through the top of the food. However, food can entirely cover the top of the core if desired.

The core usually but not necessarily functions to mold or shape a tubular microwave influx passage within the food and it is through this passage that the microwave energy enters the food throughout heating. The core also provides a thermal directing mechanism for liquid.

Next, the container with the food in it is chilled. If cooled to a low enough temperature the food is solidified to a predetermined shape. The predetermined shape may not be an absolutely permanent one, for example, if the food has a sticky or pasty consistency and is not completely solid. However, if the food is frozen, the predetermined shape will be quite permanent. In this way a tubular passage in contact with the outer surface of each core extends through the chilled food.

The food is distributed through channels of commerce within the container so that during subsequent microwave heating, microwave energy will readily pass in through the core and heat the food around each core. Heating is carried out as described above by placing the filled container within the microwave oven 12.

During operation, the bubbling and upward flow of heated liquefied food at 50 facilitates the movement of hot liquid material to the cooler regions of the package thereby distributing heat more uniformly throughout the package. The core 40 thus functions both as an influx or inlet passage for microwave energy and also as a means for directing or guiding the flow of fluid vertically at the center of the package.

Figure 6:
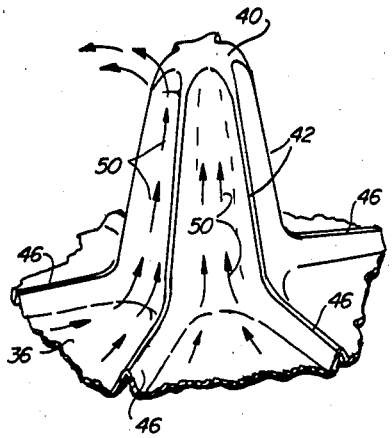
FIG. 6 is a partial perspective view showing the central core portion of the package of FIGS. 1 through 5.
Figure 7:
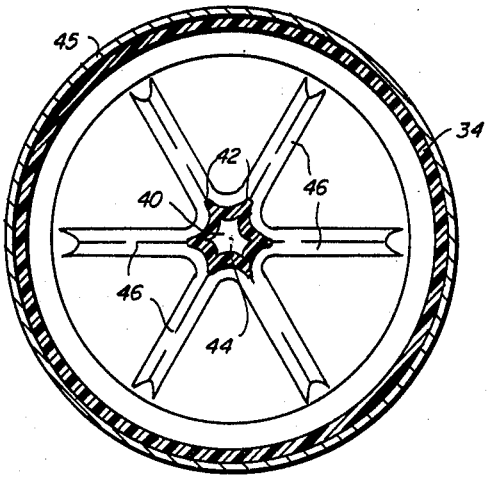
FIG. 7 is a horizontal cross-sectional view on line 7—7 of FIG. 5.

In a typical application of the invention, a serving of 7 ounces of chili with beans was heated from 40° F. in a 1000 watt oven to serving temperature (about 140° F.) in 60 seconds. The same product was heated in a 650 watt oven while frozen at 10° F. to serving temperature in three minutes. The upward flow of liquefied food at 50 is best seen in FIG. 6 between the ribs 42. This flow helps to distribute the heat more uniformly throughout the food body as it becomes warmed within the microwave oven. It will be noticed that the flow lines are vertical and generally parallel to the longitudinal axis of the core 40. It will also be seen that the radial rib extensions 46 help to guide the hot liquid portion of the food product at the bottom toward the center of the core 40. In addition, they help to strengthen the package. Their primary function, however, is to guide the flow of liquefied foods centrally toward the core 40. It has been noticed that packages containing the radial rib extensions 46 are heated more uniformly after a given period of heating than similar packages that do not contain such ribs. The ribs 42 and 46 also add structural strength at elevated temperatures. It was discovered that the packages of the invention have a lower surface temperature. It is believed that the added surface area provided by the ribs 42 and 46 enables the container to radiate heat more rapidly and thereby helps to prevent over-heating at the surface. For this reason plastics and other materials of marginal operating characteristics have better strength after heating.

It was noted in preliminary studies during the development or invention that changes in core and rib size can produce some differences in heating rate and uniformity. However, the optimum size core and rib for one food will not necessarily be optimum for another. It was found, for example, that in heating various main dishes, etc., that outstanding results could be obtained with a core having a height of 1.7 inches, a diameter at the bottom of about 1 inch, a diameter at the top of about 0.3 inch with six ribs, each having a height as seen in cross-section of about 0.2 inch. Thus, the core height in this case is about two times the diameter of the core at the base. It was also discovered during these tests that three large ribs each about ¼ inch square would not produce the uniformity and speed of internal heating that was found with ribs as shown in the figures although some improvement was obtained.

Concerning core shape, it is preferred that the core comprises an elongated finger-shaped projection. The preferred height of the core for chili and for macaroni is about 1½ to about 2½ times the diameter of the core at its bottom or base. It was also found that simply making the core larger does not necessarily improve its performance for a particular food. The dimensions of the core necessary to obtain absolutely the best performance will vary with the kind and amount of food.

In one experiment a cylindrical central core was tried having the same diameter throughout its height with three large ribs of square cross section 120 degrees apart. The diameter of the core not counting the ribs was 0.6 inch. This configuration did not perform as well for heating chili as that illustrated.

As a result of tests thus far conducted it was found that the ribs 42 and 46 appear to be less important for performance when the food is not frozen. Satisfactory performance requires that different portions of the food vary no more than about 22° F. in temperature.

Without ribs 40, the flow of the hot liquefied food is not as straight along the axis of the core 40. Thus the ribs 42 appear to serve as a guide means for directing the flow of liquefied food longitudinally along the core thereby distributing heat more rapidly.

It was found that the best results are obtained when the bottom wall 36 of the container is flat and positioned approximately parallel to the top cover 26. For example, in one test the bottom wall was made conical i.e. elevated slightly near its center. This configuration was found to provide significantly less benefit than the flat bottom dish illustrated. For some foods, the bottom wall 36 can be slightly inclined upwardly proceeding toward the core to achieve improved heating.

The container can be formed of any of a variety of microwave transparent materials. The most preferred is paper or plastic or a combination of them. Even molded paper pulp can be used if it has the required moisture and oil resistance. The best results have been obtained with thin walled plastic sheet such as polysulfone, polyesters, polyethylene, polystyrene, polypropylene or other polyolefins and polymethylmathacrylate.

The shielding ring 45 when present is preferably formed from light-weight sheet material such as aluminum foil. It can however, be formed from a variety of different substances such as aluminum paint having the requisite metal content, patches of metal film or even a rigid metal ring applied to the container just before the container is placed in the oven. In this instance, the metal ring would not have to be a part of the package. It could, for example, comprise part of a metal tray or ring with the bottom cut out into which the package is placed during heating. Such a rigid metal ring could also comprise a part of the oven in some instances. This variation might be desirable where large numbers of meals are being heated e.g. in an aircraft or ship. However, in the preferred form of the invention, the shielding ring 45 comprises a circular sheet of aluminum foil bonded to the container, extending entirely around the sidewall 34 of the container and having its bottom edge located approximately a quarter of an inch above the bottom 36 of the container.

The shielding ring 45 is particularly beneficial when the food product is frozen. In this instance the shield cooperates with the core 40 to produce extremely good results when compared with a dish containing either the core alone or the shield alone. An important benefit of the shielding ring 45 is the relatively low temperature of the outside of the package following heating. This enables it to be removed from the oven by hand without burning the fingers. This important advantage was noted by a number of test subjects who used the invention.

The invention will be better understood by reference to the following examples.

A series of comparative tests were run in each case by heating 7 ounces of frozen chili at 0° F. for 3 minutes in a 650 watt home microwave oven with 8 temperature probes per sample to sense the temperature both near the outside and near the center of the package. The results were as follows:

TABLE I

| Example | Description of Package | Average Temperature Difference Between Inside & Outside | Mean Temperature The Food Mass |
|---|---|---|---|
| 1 | The invention as exemplified by FIGS. 1-7 | 22° F. | 151.2° F. |
| 2 | Like Example 1 but with no shield 45 | 39° F. | 148.6° F. |
| 3 | Container FIGS. 1-7 with shield 45 but no core 40 | 48° F. | 115.9° F. |
| 4 | Container with non-ribbed core (FIGS. 8-8a and no shield) | 88° F. | 126.9° F. |
| | COMPARATIVE EXAMPLE | | |
| 5 | Ordinary flat bottomed dish with no core or shield | 115° F. | 118.9° F. |

By reference to Examples 1-5, it will be seen that a core alone (Example 4) reduces the temperature difference by 27° F. and increases the mean temperature by about 8° F. The use of a ribbed core and shield (Example 1) reduces temperature differences by 93° F. and surprisingly increases the overall heat absorbed, the mean temperature being 32° F. warmer than Example 5. This demonstrates the surprising ability of the invention to cause the food to reach a higher mean temperature after the same heating conditions in a microwave oven. While the reason for these improvements is not known with certainty, it is hypothesized that less heat is wasted in boiling-away steam. Comparing especially the last column of Table I with, for example, the above noted U.S. Pat. Nos. 2,600,566 and 2,714,070 it will be seen that while the patents retard heating, the invention does just the opposite; it enhances heating. Moreover, the shield functions, when used, to achieve more even heating instead of producing temperature differences.

A second set of runs were conducted in each case by heating 7 ounces of chili at 40° F. for 60 seconds in a 1000 watt oven. Again 8 temperature sensing probes were used in each sample to record the temperature both around the periphery and near the center. The average temperature differences between the inside and outside were as follows:

TABLE 2

| Example | Description of Package | Average Temperature Difference |
|---|---|---|
| 6 | The invention as exemplified by FIGS. 1-7 | 6° F. |
| 7 | Like Example 6 but with no shield 45 | 27° F. |
| 8 | Container with non-ribbed core (FIGS. 8-8a and no shield) | 53° F. |
| | COMPARATIVE EXAMPLE | |
| 9 | Ordinary flat bottom plastic dish with no core or shield | 69° F. |

By reference to Examples 6-9 it will be seen that the non-ribbed core (Example 8) produces a temperature difference of 16° F. less than an ordinary plastic dish (Example 9) and in the case of Example 6 the temperature difference between the center and the outside is 63° F. less than Example 9. Moreover, improvements were achieved even though the food was in a liquid condition before heating was started.

The reference to a low-loss core herein is a reference to a core whose wall is substantially transmissive to microwave energy and causes little loss or absorption of the energy on its way to the food in the container.

What is claimed is:

1. A process for preparing a sealable package of liquid-containing food to be heated in a microwave oven comprising, providing a disposable shipping container including a wall member comprising a dish body having a bottom wall and an internally rib-free, upwardly-directed peripheral sidewall at the outer periphery of said bottom wall with an upper edge defining an upwardly-open wide mouth;

said dish body bottom wall having a centrally-disposed, upwardly-extending, upwardly-tapering hollow core positioned thereon and projecting vertically within said container;

filling the container with a liquid-containing food capable of coupling with microwave energy and sealing the open mouth of the container by securing to said side wall a removable cover formed from sheet material;

said core comprising a finger-shaped member extending between said bottom wall and said cover and having a closed upper end positioned in proximity to said cover;

said core including surface means thereon within said sealed cavity providing a perimetrically-extending wall having a plurality of angularly-neighboring ribs extending longitudinally therealong;

said core being perimetrically surrounded by said body of food;

chilling the container and the food therein;

said body of chilled food in said sealed cavity containing water in liquid or frozen form, being in the range of about 40° F. and about 0° F., and said body of chilled food filing said sealed cavity at least to a substantial depth within which said food is disposed for contact with said ribs of said core and with said rib-free sidewall, and existing as a unitary entity without partitionment into a multiplicity of unconnected entities;

said core wall and cover being substantially transmissive of microwave oven microwave energy for functioning in use as a microwave influx passage for entry of microwave energy into said food within said container;

said core including said ribs thereof being structured and arranged for functioning during microwave heating of said food as a guide means for directing the flow of fluid portions of said food in an upward direction in the vicinity of said core, whereby said core including said ribs thereof contributes to the distribution of heat in said container during microwave heating of said food in said container in a microwave over by assisting in fluid convection and the absence of ribs on said sidewall within said cavity cooperates with the presence of said ribs on said core to balance microwave heating of said food throughout said cavity and provide more uniform heating of said food than would a similar package having ribs provided on its peripheral sidewall within its cavity.

2. The process of claim 1 wherein the food is chilled to freeze the food.

3. The process of claim 1 including providing the container with a microwave reflective shield on said side wall extending circumferentially of the package to enhance heating of the food.

4. The process of claim 1 wherein the food therein is guided during microwave heating to flow across said bottom wall in the direction of said core by the provision of radially extending flow guiding ribs projecting upwardly from said bottom wall of said container, thereby directing the flow of food when liquefied toward said core to thereby assist in the distribution of heat throughout said container during heating.

5. The process of claim 1 wherein the package after being filled and sealed is shipped to the user in a frozen condition.

6. The process of claim 5 wherein after shipment and before heating by the application of microwave energy, the food is allowed to thaw to above freezing temperature.

7. The process of claim 1 wherein the food comprises a single serving of food of about 5-10 ounces in weight and is heated in a 650-watt microwave oven for about three minutes from a frozen condition to thereby provide a hot food product without noticeable temperature differences throughout and in condition for serving.

* * * * *